United States Patent [19]

Kersten et al.

[11] Patent Number: 4,616,760

[45] Date of Patent: Oct. 14, 1986

[54] PORT AND CLOSURE ASSEMBLY FOR A CONTAINER

[75] Inventors: Jean Kersten, Villers St. Amand; Jean M. Mathias, Nivelles, both of Belgium

[73] Assignee: Baxter Travenol Laboratories, Inc., Deerfield, Ill.

[21] Appl. No.: 696,567

[22] Filed: Jan. 30, 1985

[51] Int. Cl.[4] ..... B65D 41/02

[52] U.S. Cl. ..... 215/232; 220/359

[58] Field of Search ..... 215/232; 220/359; 229/48 SB

[56] References Cited

U.S. PATENT DOCUMENTS 3,272,422 9/1966 Miller ..... 229/48 SB 3,501,042 3/1970 Risch et al. ..... 215/232

*Primary Examiner*—Donald F. Norton

*Attorney, Agent, or Firm*—Paul C. Flattery; John P. Kirby

[57] ABSTRACT

A port and closure for a container is provided. The closure includes an interface layer for bonding the closure to the port. The bond strength of the interface layer to the closure is less than the bond strength of the interface layer to the port. The closure being removed from the port by delaminating the interface layer from the port.

12 Claims, 4 Drawing Figures

PORT AND CLOSURE ASSEMBLY FOR A CONTAINER

BACKGROUND OF THE INVENTION

The present invention relates to containers having openings and closures for the openings. Specifically, the present invention relates to sterile solution containers that include ports and closures for sealing the port.

There are many applications in which solutions and other liquids are stored in containers that are accessed through ports or the like. Specifically, in the pharmaceutical industry, such containers are utilized to store dextrose, saline, and the like that are supplied to hospitals for infusion into a patient. Typically, the sterile liquid within the container is accessed through ports or the like. Because the fluid within the containers is to be infused intravenously into a patient, it is necessary that the fluid and the container are maintained as a sterile environment. Moreover, to the extent possible, it is necessary for the port through which the container is accessed to be sterile.

Accordingly, it is desirable to seal the port with a closure or other type of protective covering. Of course, because the container is to be accessed through the port, it is necessary that this closure or protective covering be removable. It is also desirable for the closure to be tamper evident so that the user can visually determine if the sterile environment of the port has been violated.

One prior art method of sealing ports is to bond a closure directly to the port. The bond between the closure and the port is constructed so that the closure fractures from the port upon the application of a sufficient force. Difficulty is experienced with these types of closures in that excessive force is sometimes required to fracture or remove the closure. It is also known to provide a closure wherein a frangible section is provided around the closure's base; the frangible section being defined by a series of slots or cuts in the closure. The disadvantage with such a structure is that a sterile environment is not maintained within the closure.

It is also known to provide a frangible section on the closure adjacent to the seal between the closure and the port. However, the frangible sections of these closures commonly require flexural shear force to fracture and the required force is frequently too great for many applications.

Another type of closure for ports is to utilize a polyvinyl chloride sleeve that covers the port and is removed by being slipped back away from the port. Aluminum foil is also utilized and is removed by being pulled off the port. Both of these closures suffer the disadvantage in that they limit the penetration of the steam that is utilized to sterilize the port. This in turn increases the length of time needed to sterilize the container to achieve the desired kill effect.

Accordingly, there is need for an improved closure and port assembly that overcomes the problems and disadvantages of the prior art.

SUMMARY OF THE INVENTION

The present invention provides a port and closure assembly for a container comprising a port and a closure for the port. The closure includes an interface layer for bonding the closure to the port. The bond strength of the interface layer to the closure is less than the bond strength of the interface coating to the port. The closure is removed from the port by delaminating the inferface layer from the closure.

Preferably, the closure is constructed from a polyamide and the interface layer and port are constructed from polyethylene on polyvinyl chloride.

The closure may have a cup-like shape. The top portion of the cup-like shaped closure may have a greater width than the corresponding side walls.

Accordingly, it is an advantage of the present invention to provide an improved closure for sealing a port of a container.

Another advantage of the present invention is that it provides a closure that seals the port of a container yet is easily removed by the user.

A further advantage of the present invention is that it provides a closure that does not substantially increase the time needed for sterilization of the container and port.

Moreover, an advantage of the present invention is that it provides a tamper evident closure.

An additional advantage of the present invention is that the closure of the present invention may be removed without excessive force being exerted thereon.

Another advantage of the present invention is that the closure may be removed without contaminating the port by touch contamination.

A further advantage of the present invention is that the closure of the present invention is smaller than many of the prior art closures.

Additional features and advantages of the present invention are described in, and will be apparent from, the detailed description of the present invention and the drawings.

DETAILED DESCRIPTION OF THE PRESENTLY PREFERRED EMBODIMENTS

Figure 1:
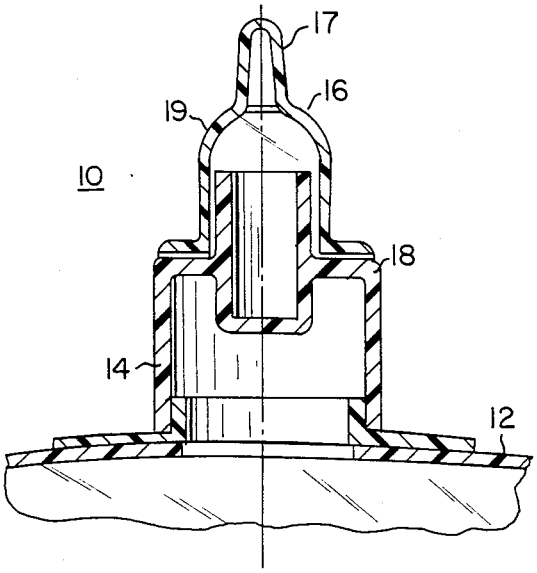
FIG. 1 illustrates a cross sectional view of an embodiment of the port and closure assembly of the present invention.

FIG. 1 illustrates the closure and port assembly 10 of the present invention. As illustrated, the closure and port assembly 10 includes a port 14 and closure 16. The port 14 is utilized to access a container 12. Such containers 12 are known in the art, especially in the medical field, for storing products that are to be infused into a patient. An example of such a container with a port is the VIAFLEX ® container manufactured by Travenol Laboratories, Inc. of Deerfield, Ill.

The port 14 includes a neck member 18 having one or more openings extending therethrough. It is through the openings of the port that the fluid within the container is accessed. Because the container 12 contains fluids that are to be infused into a patient, it is necessary that the port 14 be maintained as a sterile environment until the fluid within the container is accessed. Accordingly, the closure 16 hermetically seals the port 14.

Figure 2:
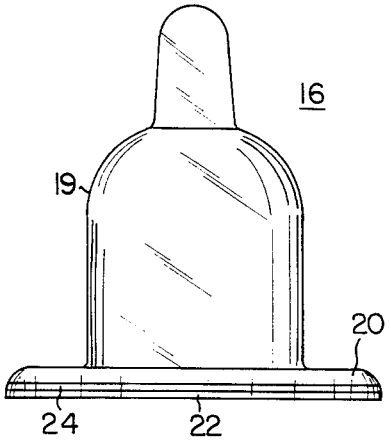
FIG. 2 illustrates a perspective view of the closure of FIG. 1.

Referring to FIG. 2, the closure 16 of the present invention is illustrated. The closure 16 includes an elongated cap portion 17, a body member 19 and rim member 20. Secured to the rim member 20 is an interface layer 22. The interface layer 22 is preferably secured to the rim member 20 by a tie layer 24. It is the interface layer 22 that is sealed to the neck 18 of the port 14 when the closure 16 seals the port.

Preferably, the interface layer 22 and the port 14 are constructed from the same material. Preferably, the interface layer 22 and port 14 are constructed from a thermoplastic. Most preferably, the interface layer 22 and the port 14 are constructed from a polyethylene, including linear low density polyethylene, low density. polyethylene, medium density polyethylene, or from polyvinyl chloride.

Figure 3:
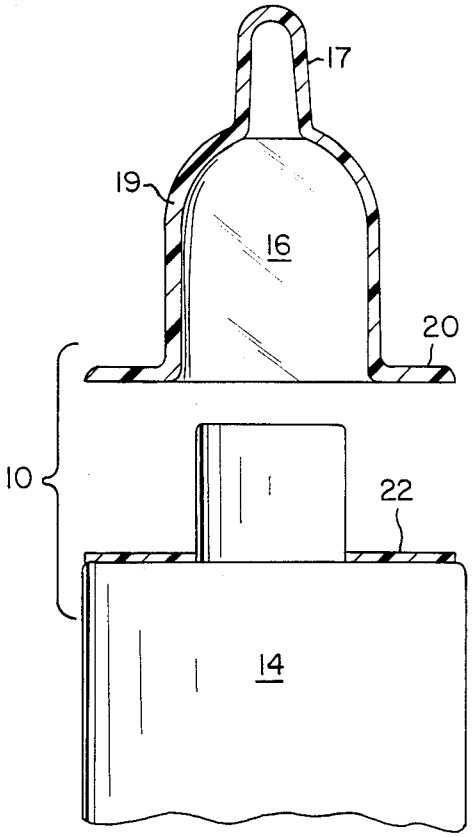
FIG. 3 illustrates a cross-sectional view of the closure of FIG. 1 after it has been removed from the port.

The closure 16 is constructed so that the bond strength between the rim member 20, or the closure member 16, and the interface layer 22 is substantially less than the bond strength between the interface layer 22 and the port 14. Accordingly, as illustrated in FIG. 3, after the port 14 has been sealed to the closure 16, and a sufficient force is exerted against the closure, the interface layer 22 will delaminate from the rim member 20 of the closure member 16. This will result in the closure 16 being removed from the port 14.

Preferably, the closure 16 is constructed from polyamide, polyvinyldiene chloride, EVOH, or some other material that will allow expedient sterilization of the port area i.e. is steam permeable. The preferred polyamide is Nylon 6 or Nylon 11.

Preferably, the tie layer 24 is a polyurethane adhesive. Preferably 1 to 10 grams per square meter of area of adhesive is utilized.

Because the interface layer 22 and the port 14 are preferably constructed from the same material, the bond strength between these two layers will be strong. Accordingly, these two layers may be heat sealed together to seal the closure 16 to the port 14. Of course, the closure 16 may be sealed to the port 14 by other sealing methods known in the art. The force needed to remove the closure 16 from the port 14 can be controlled by adjusting the thickness of the interface layer 22, the seal width, and the seal configuration. Preferably, the thickness of the interface layer 22 is between 20 and approximately to about 60 microns.

The closure 16 with interface layer 22 may be constructed by coating, lamination, coextrusion, or coinjection. The closure 16 may be thermoformed.

It is also possible for the interface layer 22 to be located on the neck 18 of the port 14. If this structure is utilized, the interface layer 22 would delaminate from the port 14 allowing the closure 16 to be removed.

Figure 4:
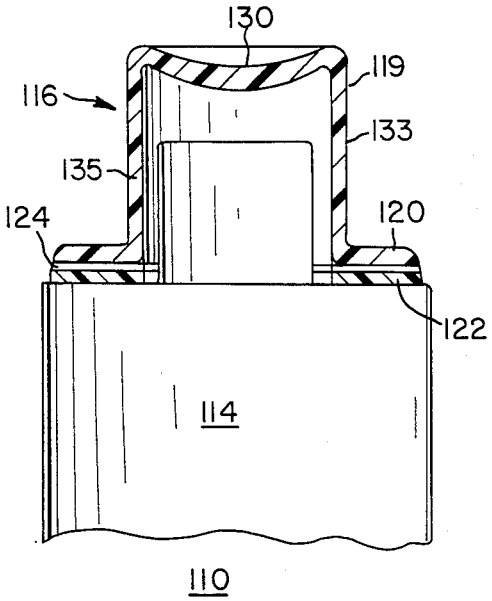
FIG. 4 illustrates a cross-sectional of another embodiment of the closure and port assembly of the present invention.

FIG. 4 illustrates another embodiment of the closure and port assembly 110 of the present invention. The closure and port assembly 110 of the embodiment illustrated in FIG. 4 includes a port 114 and closure 116. The closure 116 includes a body member 119 and an interface layer 122. The interface layer 122 is secured to the body member 119 of the closure 116 by a tie layer 124. The closure member 116 is constructed so that the interface layer 122 delaminates from the body member 119 when sufficient force is exerted on the closure 116.

The closure 116 has a cup shape construction, and is preferably thermoformed. The top portion 130 of the closure 116 has a greater cross-sectional width than the side walls 133 and 135 of the closure 116. Accordingly, when the closure 116 is gripped by the side walls 135 or 133, and these walls are compressed together, a force is exerted at the interface layer 122. This force causes the interface layer 122 to delaminate from the body member 119 causing the closure 116 to be removed from the port 114.

It should be understood that various changes and modifications to preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

We claim:

1. A port and closure assembly for a container comprising:

a port having a neck portion;

a closure for sealing the port having a cup shaped construction and including a body member having a top portion and sidewalls, and a rim member, the cross-sectional width of the top portion being greater than the cross-sectional width of the sidewalls and the rim member having a bonded thereto an interface layer, the interface layer being bonded to the neck portion of the port when the closure seals the port; and the bond strength of the interface layer to the rim member of the closure being less than the bond strength of the interface layer to the neck portion of the port so that when the sidewalls are compressed together the interface layer delaminates from the rim member of the port and the closure may be removed from the port.

2. The port and closure assembly of claim 1 wherein:

the interface layer and neck of the port are constructed from a thermoplastic material; and the body member and rim member of the closure are constructed from a polyamide.

3. The port and closure assembly of claim 1 wherein the interface layer is bonded to the rim member by a polyurethane adhesive.

4. The port and closure assembly of claim 1 wherein:

the body member and rim member of the closure are constructed from a polyamide; and the interface layer and port are constructed from a material selected from the group consisting of polyethylene or polyvinyl chloride.

5. The port and closure assembly of claim 1 wherein the closure is thermoformed.

6. A port and closure assembly for a container comprising:

a port;

a closure having a body member and an interface layer, the body having sidewalls and a top portion, the interface layer being bonded to the body member by a tie layer and sealed to the port when the closure seals the port; and the cross-sectional width of the top portion being greater than the cross-sectional width of the sidewalls and the bond strength of the interface layer to the body member being sufficiently less than the bond strength of the interface layer to the port so that the interface layer will delaminate from the body member and allow the closure to be removed from the port upon application of sufficient force.

7. The port and closure of claim 6 wherein:

the body member is constructed from polyamide;

the tie layer is constructed from polyurethane; and the interface layer and port are constructed from a thermoplastic.

8. The port and closure of claim 7 wherein:

the interface layer and port constructed from a material selected from the group consisting of polyethylene or polyvinyl chloride.

9. The port and closure of claim 7 wherein the interface layer and port are heat sealed together.

10. The port and closure of claim 7 wherein the interface layer and port are constructed from the same material.

11. The port and closure of claim 6 wherein the closure hermetically seals the port.

12. The port and closure of claim 6 wherein the body member of the closure is constructed from a steam permeable material.

* * * * *

UNITED STATES PATENT AND TRADEMARK OFFICE

CERTIFICATE OF CORRECTION

PATENT NO. : 4,616,760

DATED : October 14, 1986

INVENTOR(S) : Kersten et al.

It is certified that error appears in the above-identified patent and that said Letters Patent are hereby corrected as shown below:

Column 4, line 20 delete "a".

Signed and Sealed this

Twenty-ninth Day of December, 1987

*Attest:*

DONALD J. QUIGG

*Attesting Officer*

*Commissioner of Patents and Trademarks*